US007811069B2

(12) United States Patent
Fleig

(10) Patent No.: US 7,811,069 B2
(45) Date of Patent: Oct. 12, 2010

(54) FAN HOUSING WITH STRAIN RELIEF

(75) Inventor: Armin Fleig, St. Georgen (DE)

(73) Assignee: EBM- Papst St. Georgen GmbH and Co. KG, St. Georgen (DE)

( * ) Notice: Subject to any disclaimer, the term of this patent is extended or adjusted under 35 U.S.C. 154(b) by 1005 days.

(21) Appl. No.: 11/463,930

(22) Filed: Aug. 11, 2006

(65) Prior Publication Data

US 2007/0041857 A1 Feb. 22, 2007

(51) Int. Cl.
*F04B 35/04* (2006.01)

(52) U.S. Cl. ..... 417/423.14; 417/423.15; 417/423.1

(58) Field of Classification Search ..... 417/423.14, 417/423.15, 423.1, 354
See application file for complete search history.

(56) References Cited

U.S. PATENT DOCUMENTS

| | | | | |
|---|---|---|---|---|
| 4,949,022 | A * | 8/1990 | Lipman | 318/400.08 |
| 5,699,854 | A | 12/1997 | Hong | |
| 5,924,849 | A * | 7/1999 | Kirchgessner et al. | 417/423.15 |
| 5,984,648 | A | 11/1999 | Stopya et al. | |
| 5,988,995 | A | 11/1999 | Hong | |
| 6,023,939 | A | 2/2000 | Correa | |
| 6,174,145 | B1 | 1/2001 | Taniguchi | |
| D450,378 | S | 11/2001 | Minakuchi et al. | |
| 6,388,196 | B1 * | 5/2002 | Liu et al. | 174/135 |
| 6,942,471 | B2 * | 9/2005 | Weisser | 417/423.1 |
| 7,066,720 | B2 * | 6/2006 | Cheng et al. | 417/423.3 |
| 7,358,631 | B2 * | 4/2008 | Morishitahara | 310/71 |
| 2002/0056547 | A1 | 5/2002 | Shingai et al. | |
| 2004/0096325 | A1 * | 5/2004 | Weisser | 415/220 |

FOREIGN PATENT DOCUMENTS

| | | |
|---|---|---|
| DE | 69626688 T2 | 2/2004 |
| EP | 0882185 B1 | 12/1998 |
| WO | WO 98/26185 A1 | 6/1998 |

* cited by examiner

*Primary Examiner*—Devon C Kramer
*Assistant Examiner*—Peter J Bertheaud
(74) *Attorney, Agent, or Firm*—Oliver Intellectual Property; Milton Oliver, Esq.

(57) ABSTRACT

An equipment fan has a housing (22) that externally defines an air passage opening (41) provided in the fan (20). The fan has a motor (21) for rotatably driving blades (40) about a rotation axis (23), as well as a carrier element (51), provided between the motor (21) and the housing (22), which extends transversely to the passage (41) and is configured as a trough (53) that serves to receive an electrical lead (52) and guides the lead along a predetermined path from the motor (21) to a location (64) on the housing (22). The fan also has a deflection device (50) which, by deflecting the lead (52) at a first deflection location (55) and at a second deflection location (84) and in at least two planes extending at a predetermined angle with respect to one another, effects strain relief for the lead (52) that proceeds to the motor (21).

15 Claims, 8 Drawing Sheets

FAN HOUSING WITH STRAIN RELIEF

CROSS-REFERENCE

This application claims priority from my German application DE 20 2005 013 419.8, filed 19 Aug. 2005, the entire content of which is hereby incorporated by reference.

FIELD OF THE INVENTION

The invention relates to a fan, in particular to an equipment fan, having a fan housing and having a motor for driving fan blades that are arranged rotatably in an air passage opening provided in the fan, and having an electrical connection that leads from the motor to a housing part, and comprises at least one electrical lead that is usually in the form of a stranded conductor.

BACKGROUND

So-called strain-relief must be provided for such leads. This is because such leads are usually soldered onto a circuit board of the motor, and this soldered join cannot carry loads over the long term and can be damaged or destroyed by mechanical tension; such mechanical tension must therefore be stopped before it reaches the circuit board.

WO 2004/046 557 and corresponding US-2004-0096325, WEISSER, assigned to the assignee of the present invention, describe a fan housing having a radial enlargement, in which is provided an opening to which an electrical lead extends from a motor that is arranged in the fan housing. A latchable holding member is introduced into this opening and latched therein. In the latched state, it deflects the electrical lead at two locations through a predetermined minimum angle, thus effecting strain relief on the side of the electrical lead proceeding to the motor. The result of using this holding member is that a flexible lead can be easily be inserted, prior to assembly of the holding member, into openings provided therefor (i.e. it does not need to be threaded in), and that the lead is deflected only upon introduction of the holding member. A lead immobilized in this fashion can be removed from the strain relief element either by removing the holding member or by pulling the flexible lead, provided it is not fitted with a connector plug, out of the deflections over its entire length.

SUMMARY OF THE INVENTION

It is an object of the present invention to provide a novel fan having improved strain relief features.

According to the invention, this object is achieved by a structure which deflects the electrical lead at a plurality of deflection locations, and along at least two planes oriented at a predetermined angle with respect to each other. The result is that a flexible lead can be hooked in easily and conveniently, the lead being retained in the strain relief apparatus, and reliable strain relief being achieved. Once it has been hooked in, a lead immobilized in this fashion can be removed again from the strain relief element only by unhooking it from the deflections over its entire length, or by pulling it out.

Preferred refinements of a fan according to the present invention are described in greater detail below.

BRIEF FIGURE DESCRIPTION

Further details and advantageous refinements of the invention are evident from the exemplifying embodiments, in no way to be understood as a limitation of the invention, that are described below and shown in the drawings.

DETAILED DESCRIPTION

Figure 1:
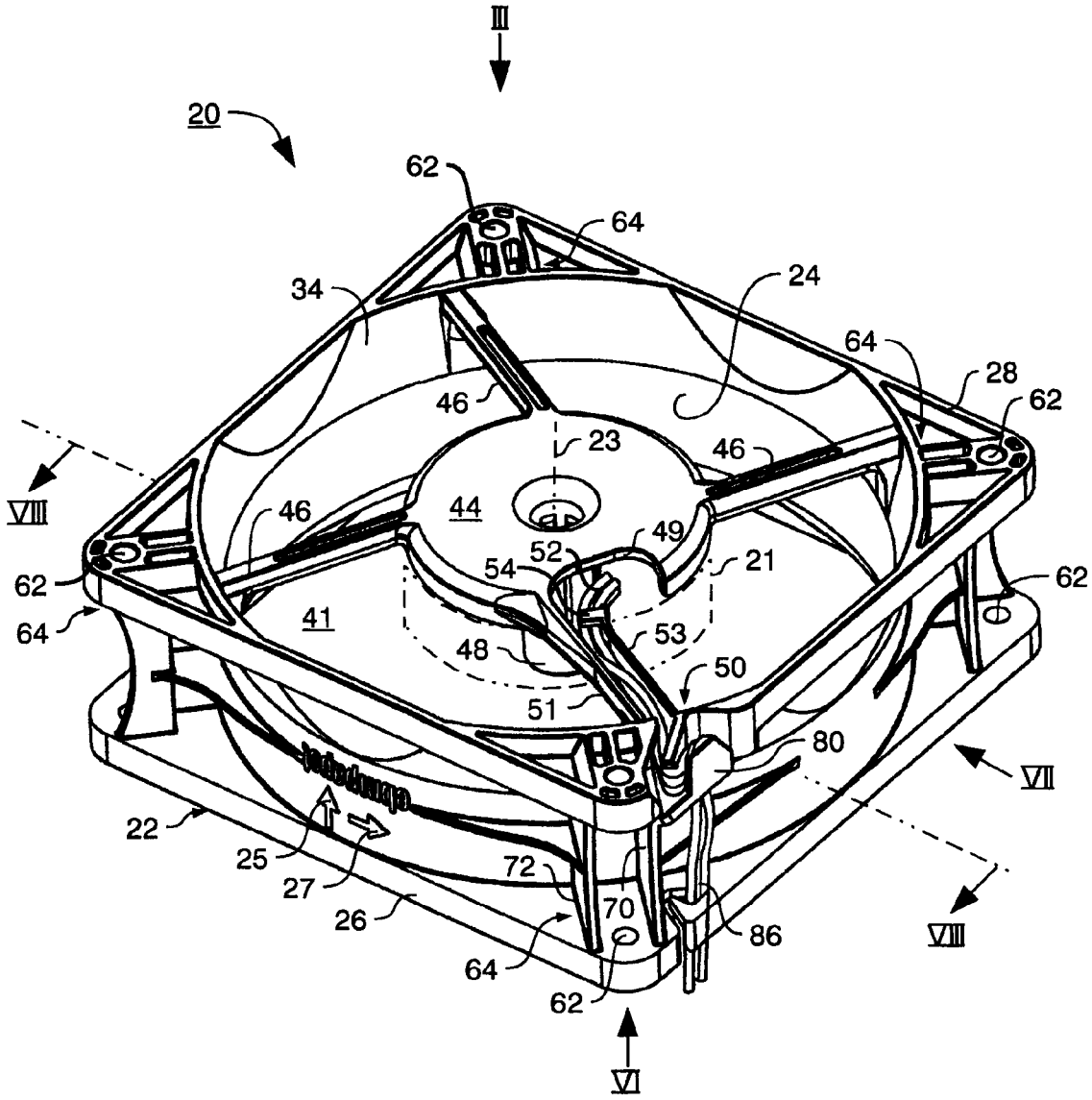
FIG. 1 is a perspective depiction of a fan according to the present invention; the motor is indicated merely schematically, and the fan blades are not depicted in FIG. 1; one such blade 40 is indicated in FIG. 3 with dot-dash lines.

In the description hereinafter, the terms "left," "right,", "upper," and "lower" refer to the respective Figure of the drawings. Identical or identically functioning parts are labeled with the same reference characters in the various Figures, and are usually described only once.

FIG. 1 is a three-dimensional depiction of an equipment fan 20 that is depicted here as an axial fan. The invention is not, however, limited to axial fans. It can instead be used in the same fashion in other types of fan, e.g. in diagonal and radial fans.

Fan 20 has a fan housing 22 that is approximately in the shape of a cylindrical tube 24 and is provided with a mounting flange 26 at its lower (in FIG. 1) end and a mounting flange 28 at its upper end. The air flow-through direction 25 is defined by an inflow side and an outflow side. FIG. 1 shows the outflow side, labeled 34, at the top.

Fan 20 has a motor 21 to drive fan blades 40 (FIG. 3) that are arranged, rotatably about a rotation axis 23, in an air passage opening 41. During operation, blades 40 rotate in the direction of an arrow 27. The shape of fan blades 40 is adapted to the shape of the inner side of tube 24. Motor 21 is preferably an electronically commutated external-rotor motor in which blades 40 are attached to the external rotor.

A mounting flange 44 that is joined via struts 46 to fan housing 22 serves for the installation of motor 21 in fan housing 22. Struts 46 are preferably implemented integrally with mounting flange 44 and housing 22. Located on flange 44 is a bearing tube 48 on which motor 21 is mounted in known fashion.

Extending through a lateral cutout 49 of flange 44 is a flexible electrical connector lead 52 of motor 21, which lead can be implemented, for example, as a multi-conductor lead. It is soldered onto a circuit board (not shown) of motor 21 and from there is guided outward to fan housing 22, a strain relief apparatus 50 being provided for lead 52, in a manner to be described below.

Lead 52 usually contains multiple flexible insulated leads, preferably so-called stranded conductors, each of which is made up of a plurality of thin wires that are surrounded by an insulating material. A fan requires two thick leads for delivery of an operating voltage. In many cases thinner leads are also provided, e.g. for a speed signal or alarm signal. All these flexible leads must be quickly and, above all, securely mounted during assembly, and this is described below.

Figure 3:
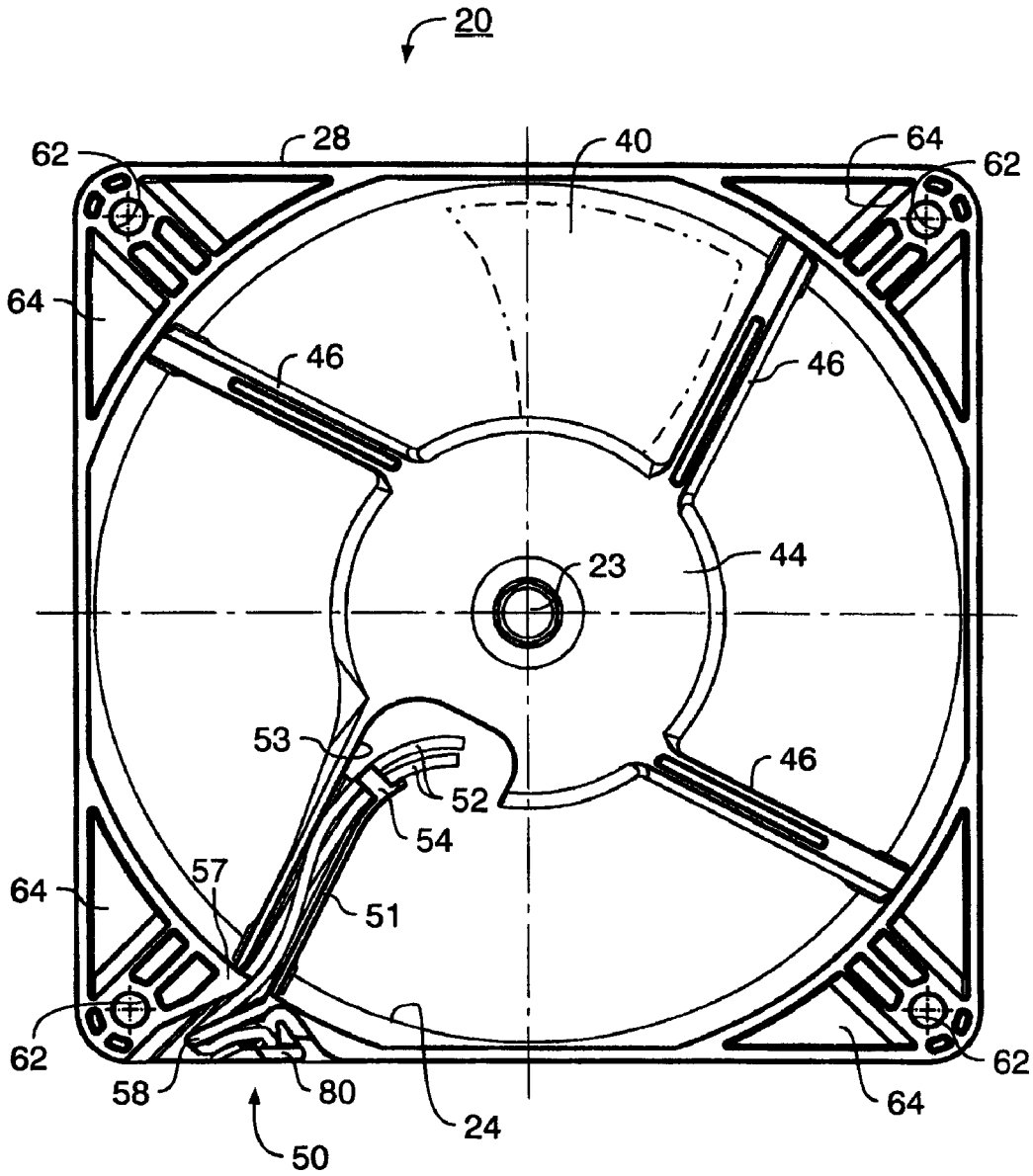
FIG. 3 is a plan view from above of the fan of FIG. 1, looking in the direction of arrow III of FIG. 1.

As FIG. 1 and FIG. 3 show, fan housing 22 has, viewed in the direction of rotation axis 23, an approximately square outline having four corners 64 at which openings 62 are provided for mounting fan 20. In a preferred embodiment, housing 22 consists essentially of plastic material, e.g. molded plastic. Alternatively, housing 22 could be made of fibers embedded in an elastomeric matrix, or other materials having suitable strength/weight ratios and durability.

Located in the region of the front (in FIG. 1) corner 64 is strain relief apparatus 50. This can be arranged at any desired location of fan housing 22, but corners 64 are particularly suitable therefor. Apparatus 50 is preferably formed integrally with fan housing 22 and serves, by deflecting lead 52 at at least two deflection locations and in two planes that converge with one another at a predetermined angle, to create a strain relief for the portion of lead 52 that proceeds to motor 21. Details of strain relief apparatus 50 are shown in great detail, especially in FIGS. 2, 4, and 5, so that a description in words would be superfluous for one of ordinary skill in the art.

Figure 2:
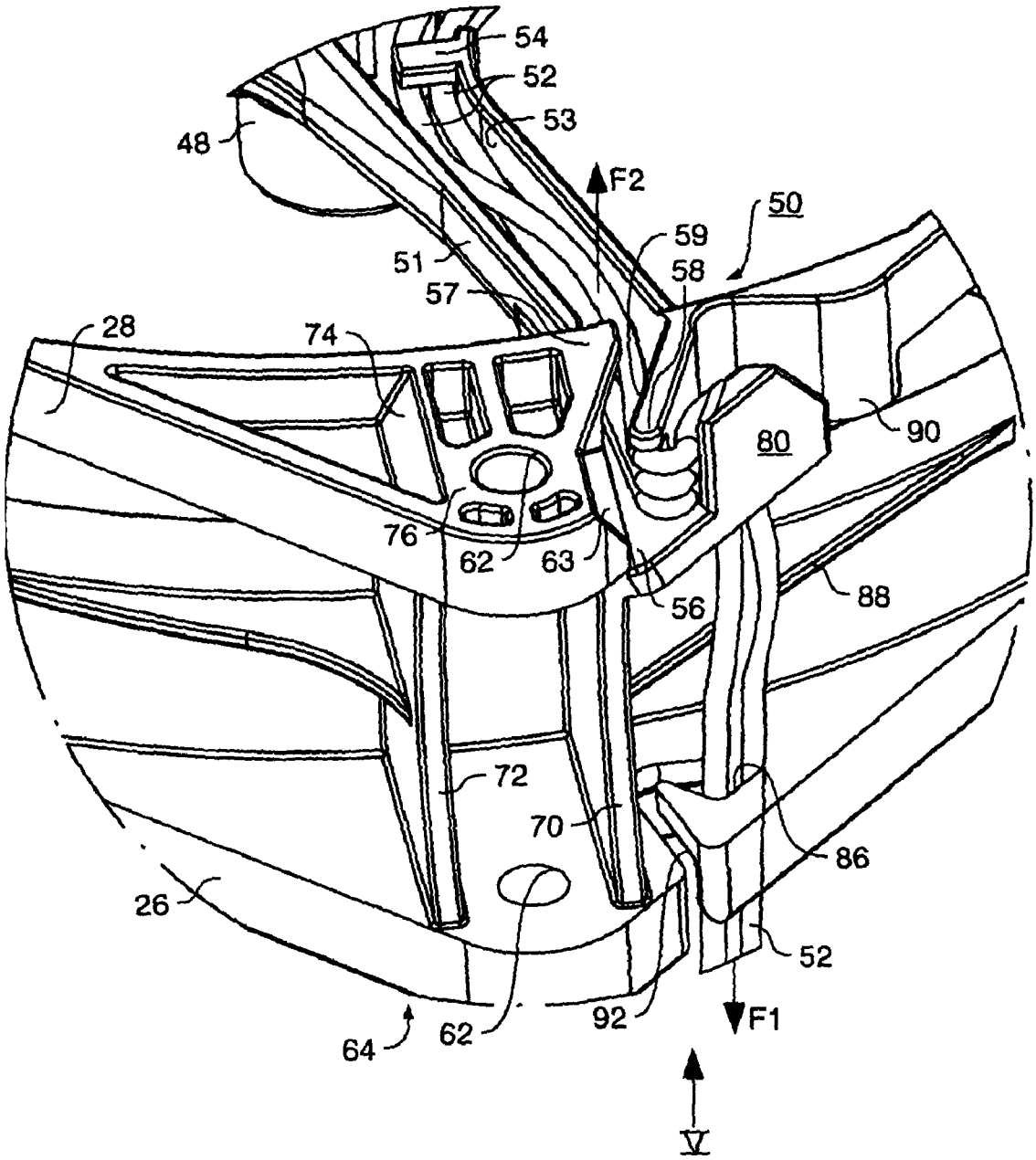
FIG. 2 is an enlarged depiction of the front (in FIG. 1) corner of the fan.

FIGS. 1 and 2 show how lead 52 emerges from cutout 49 of mounting flange 44 and is guided in a strut 51, which is arranged between motor 21 and fan housing 22 and is equipped with a guide trough 53 in which lead 52 is guided from motor 21 to a lateral delimiting surface 29 of fan housing 22, which surface is adjacent to the region of enlargement 64. To prevent lead 52 from slipping out of guide trough 53, it is prevented from slipping out there by a first hold-down 54. The latter extends only far enough that it still allows lateral insertion of lead 52 into trough 53, thus speeding up assembly.

Trough 53 continues, in the region of corner 64, into a conduit 56 (FIG. 2) that generally runs approximately in a radial direction and is depicted as being radially open toward the outside, thus making stranded conductors 52 easier to hook in.

Extending approximately transversely to conduit 56 are a second hold-down 57 that comes from the left in FIG. 2, and a third hold-down 58 that comes from the right in FIG. 2. Hold-downs 57, 58 form between them a narrow gap 59 through which stranded conductors 52 can be set in place. Gap 59 extends at an angle to conduit 56, as is clearly evident from FIG. 2. The result of this is that lead 52 cannot spontaneously release itself from conduit 56. Hold-downs 57 and 58 overlap in terms of their actions.

Figure 4:
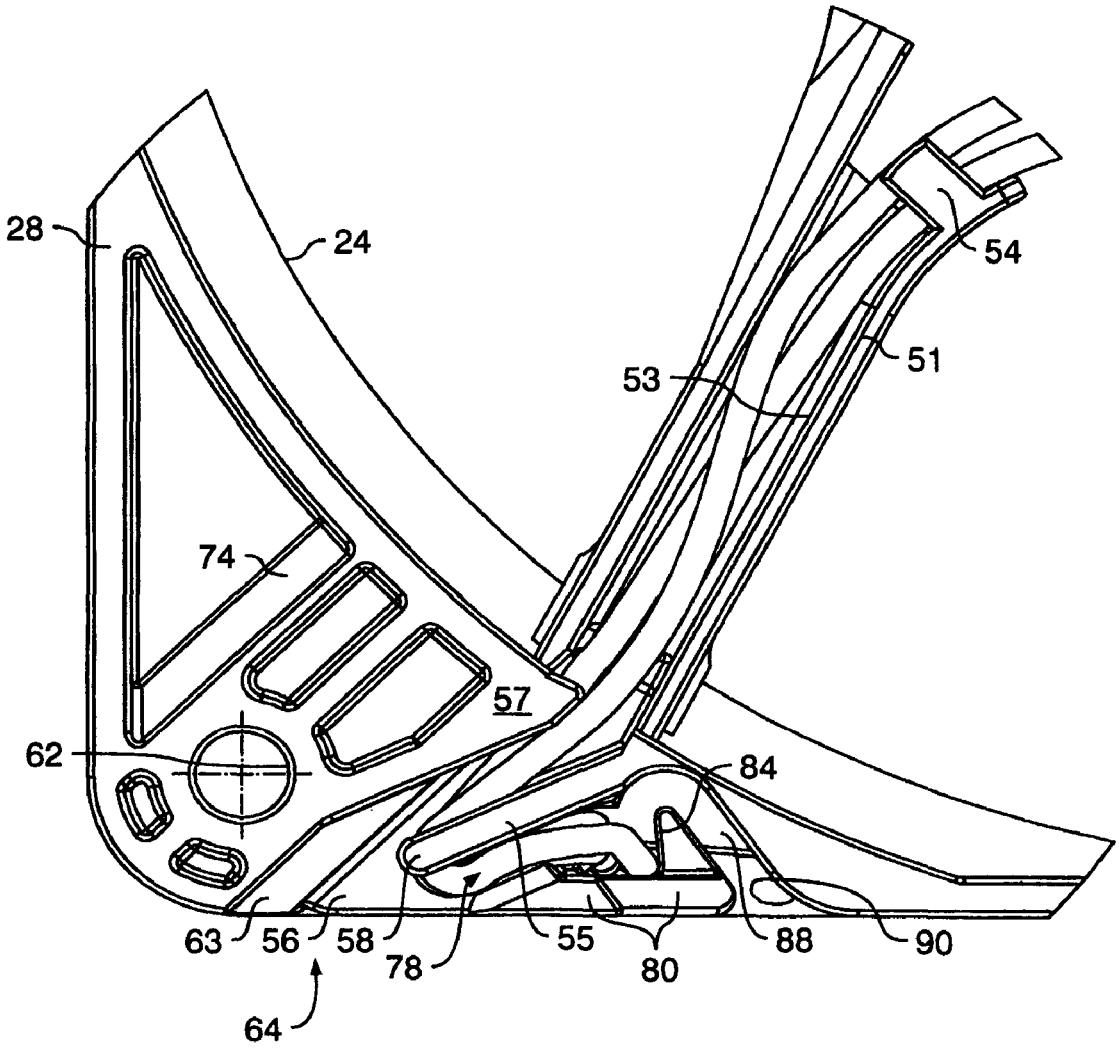
FIG. 4 is an enlarged depiction of the corner shown at the bottom left in FIG. 3.
Figure 5:
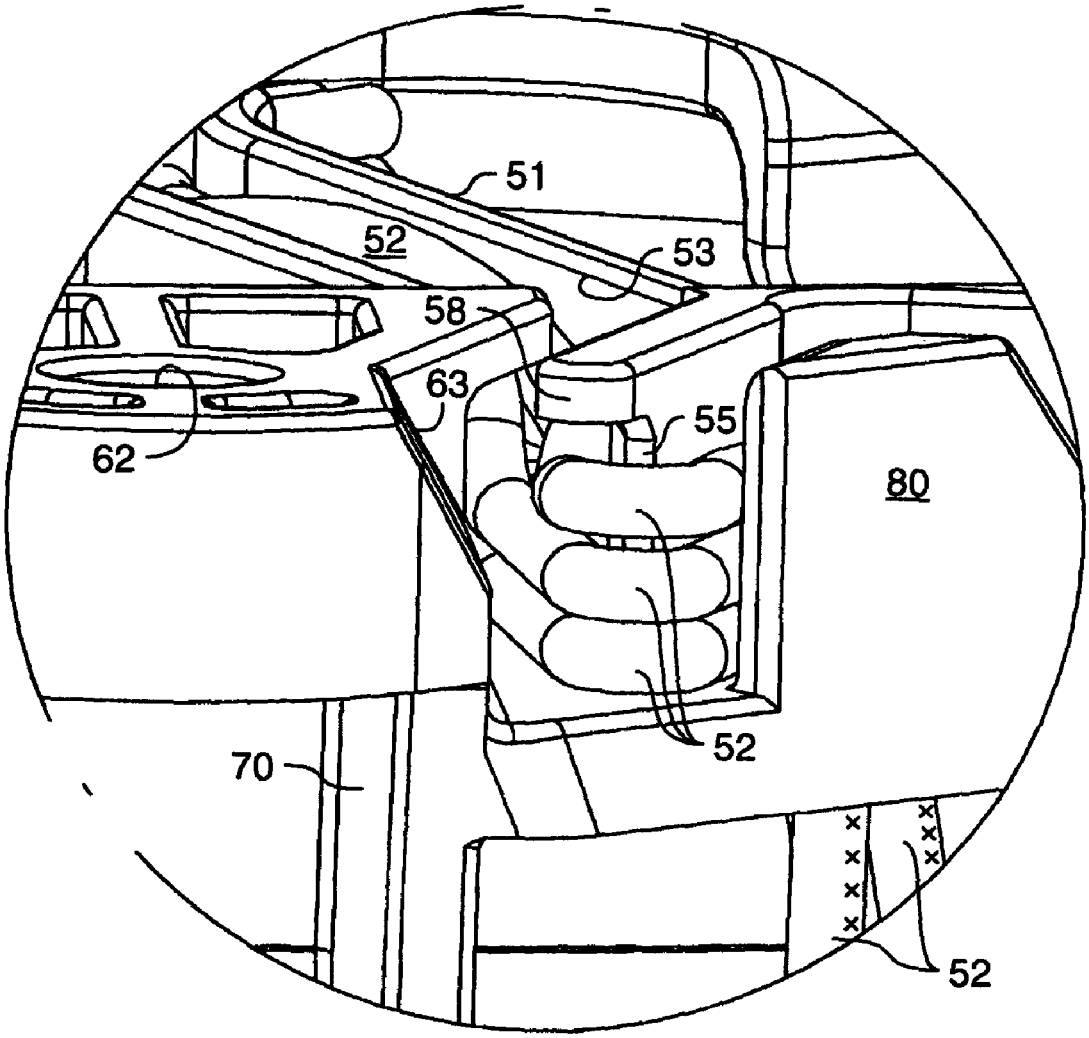
FIG. 5 is an enlarged depiction of a detail, looking approximately in the direction of arrow V of FIG. 2.
Figure 6:
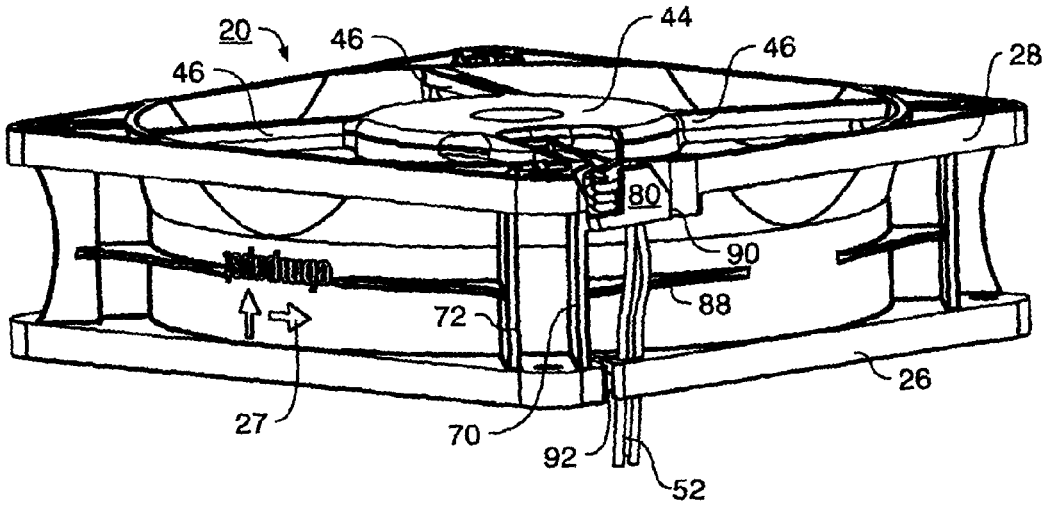
FIG. 6 is a three-dimensional depiction looking approximately in the direction of arrow VI of FIG. 1.
Figure 7:
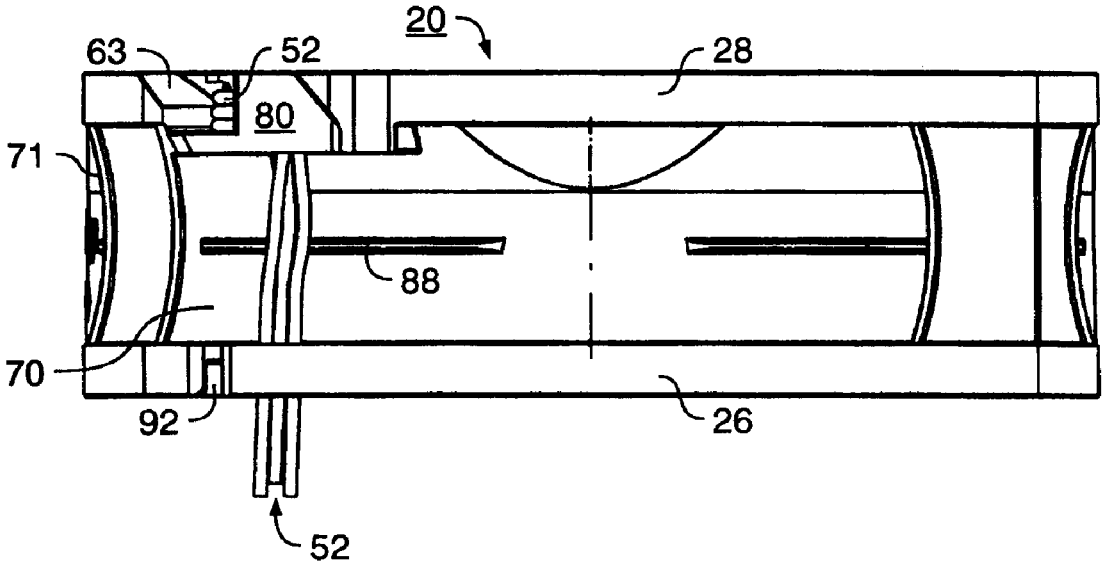
FIG. 7 is a side view looking in the direction of arrow VII of FIG. 1.

As FIG. 5 shows particularly clearly, located there below third hold-down 58 is a relatively sharp deflection edge 55 that can have, for example, a radius of 0.5 mm and around which lead 52 (as shown in FIG. 4) is deflected approximately in the opposite direction. This deflection occurs approximately in a plane that extends perpendicular to rotation axis 23, as clearly shown by FIGS. 2, 4, and 5. The deflection angle, according to FIG. 4, is more than 120° and is preferably approximately 180°. This angle is of course variable within wide limits.

To facilitate insertion, conduit 56 has, at its radially outer end, an oblique wall 63 that, as shown in FIG. 2, transitions downward into a stiffening wall 70. Extending parallel to wall 70 and at a distance therefrom is a stiffening wall 72 that transitions upward, via an oblique wall 74, into upper flange 28. Stiffening walls 70, 72 extend between flanges 26 and 28. Upon assembly of the fan, oblique walls 63, 74 (and corresponding oblique walls on lower flange 26) direct the force of a mounting screw (not depicted) directly from screw supporting surface 76 into ribs 70, 72, thus enabling a doubling of the tightening torque of the relevant screw and consequently allowing such a fan 20 to be mounted particularly securely.

The deflection of lead 52 around the sharp deflection edge 55 (FIG. 5), with its small deflection radius, results in elevated friction there that counteracts any longitudinal displacement of lead 52. As FIG. 5 shows, deflection edge 55 encloses an angle of approximately 30-50° with the longitudinal direction of hold-down 58. As FIG. 4 shows particularly well, a guide conduit 78, which is delimited externally by a wall segment 80, extends on the lower (in FIG. 4) side of deflection edge 55. Lead 52 extends through this guide conduit 78 as far as a second deflection location 82, at which lead 52 is deflected in a direction that extends approximately parallel to rotation axis 23. This deflection is clearly shown in FIG. 8. Lead 52 extends there from upper flange 28, through an opening 84 thereof, to an opening 86 (FIG. 2) of lower flange 26. Lead 52 thereby runs over a protruding, relatively sharp-edged rib 88 that extends from stiffening wall 70 to the outer periphery of segment 24 and extends approximately perpendicular to rotation axis 23.

Figure 8:
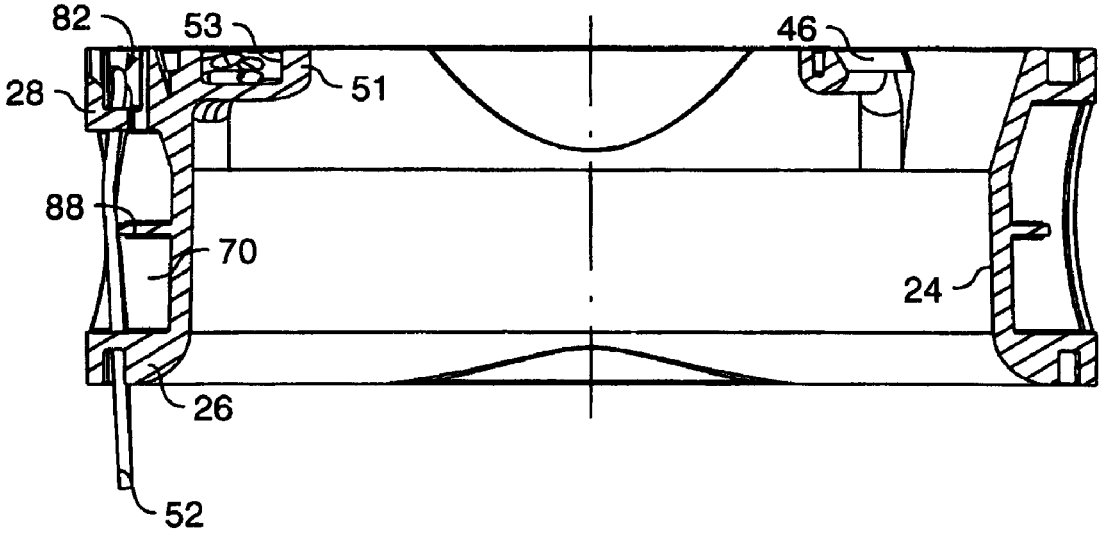
FIG. 8 is a section looking along line VIII-VIII of FIG. 1

As FIG. 8 shows, rib 88 causes a slight deflection of lead 52. The reason is as follows: Exertion of a force F1 on lead 52, as shown in FIG. 2, would of itself result in a movement of lead 52 in the direction of force arrow F2 in the region of trough 53. Rib 88 reduces force F2, and the two hold-downs 57 and 58 prevent lead 52 from jumping out of rib 53 and groove 56 as a result of force F2.

As depicted in FIG. 4, opening 84 is accessible from outside via a curved hooking-in opening 90 (in flange 28), so that stranded conductors 52 can be hooked in by means of this opening 90 but cannot then spontaneously become unhooked. This effect is reinforced by rib 88.

Opening 86 (FIG. 2) in lower flange 26 is accessible from outside via an approximately spiral-shaped conduit 92, so that stranded conductors 52 can easily be hooked in by means of this conduit 92 but inadvertent unhooking of the stranded conductors, i.e. so-called self-release, is prevented by rib 88.

The following advantages, in particular, are obtained by way of the invention:

Stranded conductors 52 of different diameters can be used simultaneously, e.g. a thinner stranded conductor for a signal lead.

Stranded conductors 52 can be hooked in rapidly and without tools.

Strain relief 50 acts on each individual stranded conductor 52.

Self-release of the stranded conductors from strain relief 50 is largely precluded.

Strain relief apparatus 50 can be manufactured using a simple injection mold having only two sliders.

Numerous variations and modifications are of course possible, within the scope of the present invention.

What is claimed is:

1. A fan, adapted for service as an equipment fan, comprising:

a housing part (22) forming an external contour of an air passage opening (41) formed in the fan (20);

a motor (21) for rotatably driving fan blades (40), that are mounted in the air passage opening (41), about a rotation axis (23);

a carrier element (51) provided between the motor (21) and the housing part (22), the carrier element being oriented transversely to the air passage opening (41) and is configured as a trough (53) that serves to receive an electrical lead (52) and guides said electrical lead along a predetermined path or channel from the motor (21) to a predetermined location (64) adjacent an exterior of the housing part (22); and a deflection device (50) that is formed integrally with the housing part (22), and is, at least partially, adjacent said predetermined location (64) of the housing part (22) and which deflects the electrical lead (52) at a first deflection location (55) such that two electrical lead portions of said electrical lead, each contiguous to said first deflection location (55), together define a first plane generally perpendicular to said motor rotation axis (23); wherein the electrical lead is further deflected at a second deflection location (84) into a second plane which is oriented at a predetermined angle with respect to said first plane, said deflection device (50) thereby tending to prevent transmission of any longitudinal strain (F1), exerted on a motor-remote portion of said electrical lead, to a motor-adjacent portion of said electrical lead, located between said first deflection location (55) and terminals of said motor (21); and wherein the first deflection location (55) is configured to deflect a successive linear motor-remote portion of the electrical lead (52) in a direction, angled in a range exceeding 120 degrees, with respect to a prior, motor-adjacent, linear portion of said lead.

2. The fan according to claim 1, wherein the second plane is oriented generally parallel to said motor rotation axis (23).

3. The fan according to claim 2, wherein the first deflection location (55) is configured to deflect a successive portion of the electrical lead (52) in a direction approximately opposite to a prior, motor-adjacent, portion of said lead.

4. The fan according to claim 1, wherein the carrier element (51) further comprises a hold-down (54) that is configured to counteract any movement of the electrical lead (52) out of the trough (53) formed in the carrier element (51).

5. The fan according to claim 1, wherein the deflection device (50) comprises a first hooking-in opening (84) that is implemented on a first housing portion (28) that is substantially perpendicular to said rotation axis (23) and a first insertion trough (88) that ends in a first cutout (84) and is configured for insertion of the electrical lead (52) into said first hooking-in opening (84).

6. The fan according to claim 5, wherein the deflection device (50) further comprises a second hooking-in opening that is implemented on a second housing portion (26) extending substantially parallel to the first housing portion (28) and a second insertion trough (92) that ends in a second opening (86) and is adapted to facilitate insertion of the electrical lead (52) into that second hooking-in opening (86).

7. The fan according to claim 5, wherein there is provided on the housing (22) of the fan (20), between the first hooking-in opening (84) and the second hooking-in opening (86), an immobilization edge (88) that effects a deflection of the electrical lead (52) between the two hooking-in openings in order to counteract unhooking of the stranded conductors (52) from the hooking-in openings (86, 92).

8. The fan according to claim 6, wherein there is provided on the housing (22) of the fan (20), between the first hooking-in opening (84) and the second hooking-in opening (86), an immobilization edge (88) that effects a deflection of the electrical lead (52) between the two hooking-in openings in order to counteract unhooking of the stranded conductors (52) from the hooking-in openings.

9. The fan according to claim 7, wherein the immobilization edge (88) is configured as a protruding rib.

10. The fan according to claim 8, wherein the immobilization edge (88) is configured as a protruding rib.

11. The fan according to claim 1, wherein said fan housing (22) consists essentially of plastic material.

12. The fan according to claim 1, wherein said fan housing (23) consists essentially of fibers embedded in an elastomeric matrix material.

13. The fan according to claim 1, wherein the fan housing (22), viewed in the direction of the rotation axis (23), has an approximately square outline formed with corners (64);

and said deflection device (50) is arranged adjacent one corner (64).

14. The fan of claim 1, wherein said carrier element is a strut (51) oriented generally radially between said motor (21) and an exterior of said housing part (22).

15. The fan of claim 1, wherein the two portions of said electrical lead contiguous to said first deflection location (55) are oriented substantially radially with respect to said motor rotation axis (23).

* * * * *

UNITED STATES PATENT AND TRADEMARK OFFICE

CERTIFICATE OF CORRECTION

PATENT NO. : 7,811,069 B2
APPLICATION NO. : 11/463930
DATED : October 12, 2010
INVENTOR(S) : Fleig It is certified that error appears in the above-identified patent and that said Letters Patent is hereby corrected as shown below:

Title page, below Item (22)

ADD:

(30) Foreign Application Priority Data (DE) 20 2005 013419.8 AUG. 19, 2005

Signed and Sealed this

Thirtieth Day of November, 2010

David J. Kappos

David J. Kappos
*Director of the United States Patent and Trademark Office*